US006596914B2

(12) United States Patent
Gore et al.

(10) Patent No.: US 6,596,914 B2
(45) Date of Patent: Jul. 22, 2003

(54) METHOD OF DESULFURIZATION AND DEAROMATIZATION OF PETROLEUM LIQUIDS BY OXIDATION AND SOLVENT EXTRACTION

(76) Inventors: Walter Gore, 201 Arctic Slope Ave., Anchorage, AK (US) 99518; Steve Bonde, 201 Arctic Slope Ave., Anchorage, AK (US) 99518; Geoffrey E. Dolbear, 23050 Aspen Knoll Dr., Diamond Bar, CA (US) 91765; Ebbe R. Skov, 25652 Santo Dr., Mission Viejo, CA (US) 92691

( * ) Notice: Subject to any disclaimer, the term of this patent is extended or adjusted under 35 U.S.C. 154(b) by 29 days.

(21) Appl. No.: 09/941,131

(22) Filed: Aug. 25, 2001

(65) Prior Publication Data

US 2002/0035306 A1 Mar. 21, 2002

(51) Int. Cl.[7] ..... C07C 7/10; C10G 17/02; C10G 45/00; C10G 17/06

(52) U.S. Cl. ..... 585/833; 208/211; 208/212; 208/219; 208/220; 208/221; 208/222; 208/223; 208/224; 208/240

(58) Field of Search ..... 585/833; 208/211, 208/212, 219, 220, 221, 223, 224, 222, 240

(56) References Cited

U.S. PATENT DOCUMENTS 4,485,007 A * 11/1984 Tam et al. ..... 208/221
4,746,420 A * 5/1988 Darian et al. ..... 208/222
6,160,193 A * 12/2000 Gore ..... 585/833

* cited by examiner

*Primary Examiner*—Walter D. Griffin
*Assistant Examiner*—Tam M. Nguyen
(74) *Attorney, Agent, or Firm*—Michael Tavella

(57) ABSTRACT

A multi-step process for desulfurizing liquid petroleum fuels that also removes nitrogen-containing compounds and aromatics. The process steps are: thiophene extraction; thiophene oxidation; thiophene-oxide and -dioxide extraction; raffinate solvent recovery and polishing; extract solvent recovery; and recycle-solvent purification. The thiophene oxidation is accomplished with hydrogen peroxide and the extraction solvent is acetic acid in combination with secondary solvents. The operating conditions in the process are relatively mild at near ambient pressure and less than 145° C. throughout the process, and the only chemical consumed in the process is hydrogen peroxide. The process design can be modified to accommodate a variety of liquid hydrocarbon feeds. Depending on the selected feedstock and product specifications, several process design variations are readily apparent, including the design of the extraction process sections, the solvent purification sections and the elimination of the thiophene extraction section.

75 Claims, 2 Drawing Sheets

METHOD OF DESULFURIZATION AND DEAROMATIZATION OF PETROLEUM LIQUIDS BY OXIDATION AND SOLVENT EXTRACTION

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to a method of removing sulfur- and nitrogen-containing compounds from petroleum liquids and particularly to a method of desulfurization of fuel oils using aqueous acetic acid.

2. Description of Related Art

Environmental concerns have driven the need to remove many impurities from hydrocarbon based distillate fuels. Sulfur- and nitrogen-containing compounds are of particular interest because of their tendencies to produce precursors to acid rain and airborne particulate material. In addition, sulfur in particular can poison the catalysts used on automobiles and trucks to remove pollutant species. Several processes have been proposed in the past to deal with the problem of removing of these compounds from fuels. The most prevalent and common industrial process, and only large scale desulfurization process used to treat liquid fuels in refineries, is that of treating the fuel under high temperatures and high pressures with hydrogen. This process is called hydrotreating and has received extensive attention since its original invention in Germany before the Second World War. Literature describing this technology is immense, amounting to thousands of patents and scientific and engineering publications.

Briefly stated, hydrotreating is a process in which a petroleum fraction is heated, mixed with hydrogen, and fed to a reactor packed with a particulate catalyst. Temperatures in the reactor typically range from 600 to 700° F. (315 to 370° C.). At these temperatures, some or all of the feed may vaporize, depending on the boiling range of the feed and the pressure in the unit. For heavier feeds, it is common for the majority of the feed to be liquid. Reaction pressures range from as low as 500 psig (pounds per square inch, gauge) to as high as 2500 psig depending on the difficulty of removing the sulfur. In the manufacture of distillate fuels such as diesel or jet fuel, pressures higher than 800 psig are common. The feed and hydrogen mixture typically flows downward through the reactor, passing around and through the particulate catalyst. Upon leaving the reactor, the mixture of treated fuel and hydrogen flows through a series of mechanical devices to separate and recycle the hydrogen, remove poisonous hydrogen sulfide generated in the reaction, and recover the desulfurized product. Hydrotreating catalysts slowly lose activity with use, and must be removed and replaced every two to three years.

As used in large integrated refineries, hydrotreating is very effective, relatively inexpensive, and rather inefficient at removing the "refractory" substituted benzo- and di-benzo-thiophenes. However, in small refineries, and especially those with limited capabilities, it can be prohibitively expensive because of the effects of scale-up economics. When process equipment is built, it typically costs much less than twice as much to build a unit with twice the capacity; engineers typically estimate that doubling the size increases the cost by only about 50%. The converse of the scale-up effect occurs when processes are scaled down; smaller process units are only slightly less expensive to build than larger ones. Thus the investment for a small 5,000 barrel per day (bpd) hydrotreater is about 25% of a 40,000 bpd hydrotreater and not 12.5% of the cost of the much larger unit; hence the unitary cost of the smaller unit is approximately twice that of the larger unit.

Because of the way processes are operated and controlled, the manpower costs for the smaller unit are roughly the same as those of the larger one.

Another cost problem faced by small refiners is the lack of an inexpensive hydrogen source. Hydrotreating typically consumes 200 to 500 scfb (standard cubic feet per barrel) of hydrogen, and may consume as much as 1000 scfb. Manufacture of hydrogen from natural gas typically costs about $3 per 1000 scf, adding about $0.60 to as much as $3.00 to the cost of treating a barrel of feed for a small refinery. In large refineries, hydrogen is often available as a byproduct of the gasoline manufacturing process known as platinum reforming. As such, it is virtually free. In small refineries with no platinum reformer, a dedicated hydrogen manufacturing plant must be installed, adding to the refinery operator's investment burden and operating costs.

These economics favor those who wish to operate at large scale, but they make hydrotreaters prohibitively expensive for smaller refineries. This is one of the factors contributing to the closure of small refineries under the pressure of tightening environmental regulations. Some small refineries have survived by changing product mix to emphasize low value products such as asphalt, selling liquid products to large refineries to use as intermediates.

In order to continue to operate successfully, refineries and others have explored alternatives to hydrotreating. One idea that has been explored involves oxidizing the sulfur and nitrogen compounds in a distillate then removing them by selective extraction. This approach has met with only limited success primarily because of problems of non-selectivity of oxidants or the extraction solvents, problems that led to unacceptably high processing costs.

The complete removal of sulfur present in feedstock as sulfides, disulfides and mercaptans, is recognized as relatively easy, and comparatively inexpensive processes can accomplish this goal. Considerably more problematic are the family of "refractory sulfur compounds." These compounds include the benzothiophenes and dibenzothiophenes and their mono-, di- and tri-substituted homologues with alkyl groups containing from one to 12 carbons. They are typically encountered within a boiling range of 220–350° C., molar weight range of 134–300 Dalton, and carbon number of 8–24. These compounds have very high sulfur levels (in the range of 11–24 wt %). For example, the thiophenes found in Light Atmospheric Gas Oil (LAGO) from Alaska North Slope Crude containing about 5000 ppm sulfur typically have the following inspection:

| Carbons | C8–C9 | C10 | C-11 | C-12 | C13+ | Total |
|---|---|---|---|---|---|---|
| MW Range | 134–148 | 162 | 176 | 184–190 | 204–218 | |
| Fraction, wt % | 5 | 34 | 27 | 26 | 8 | 100 |

In U.S. Pat. No. 3,847,800, Guth and Diaz proposed a process for treating diesel fuel that used oxides of nitrogen as the oxidant. However, nitrogen oxides have several disadvantages that can be traced to the mechanism by which they oxidize distillates. In the presence of oxygen, nitrogen oxides initiate a very non-selective form of oxidation termed auto-oxidation. Several side reactions also take place including the creation of nitro-aromatic compounds, oxides of alkanes and arylalkanes, and auto-oxidation products. Thus, nitrogen oxide based oxidants do not yield the appropriately oxidized sulfur compounds in distillate hydrocarbons without creating many undesirable byproducts.

The Guth and Diaz patent also proposes the use of methanol, ethanol, a combination of the two, and mixtures of these and water as an extraction solvent for polar molecules. Although these have proved to be acceptable extraction solvents for some polar compounds, they do not perform as well as others.

U.S. Pat. No. 4,746,420, issued to Darian and Sayed-Hamid also proposes the use of a nitrogen oxides to oxidize sulfur- and nitrogen-containing compounds followed by extraction using two solvents—a primary solvent followed by a cosolvent that is different from the primary. The sulfur and nitrogen results published in this patent are consistent with those expected from incomplete oxidation of these compounds followed by extraction.

In European Patent Application number 93302642.9 to Aida titled Method for Recovering Organic Sulfur Compounds from a Liquid Oil, Aida claims many oxidants as being essentially equal in their ability to oxidize sulfur- and nitrogen-containing compounds. However, it has been discovered that many of these oxidants are not selective and others are ineffective. Oxidizers that proceed by an auto oxidation mechanism involving a free radical tend not to be selective for the sulfur- and nitrogen-containing compounds of interest, producing numerous side reactions and, hence, various undesirable byproducts.

Aida teaches the use of distillation, solvent extraction, low temperature separation, adsorbent treatment and separation by washing to separate the oxidized organic sulfur compound from the liquid oil through the utilization of differences in the boiling point, melting point and/or solubility between the organic sulfur compound and the oxidized organic sulfur compound. While most of these work with some success, they do not provide the level of sulfur removal needed to meet environmental regulations.

In "Desulfurization of Petroleum Fractions by Oxidation and Solvent Extraction", *Fuel Processing Technology,* 1995, 42, 35–45, by F. Zannikos, E. Lois, and S. Stournas, the authors describe an oxidation and solvent extraction technique for the removal of sulfur containing compounds. Peroxyacetic acid was used in an inefficient manner to oxidize the sulfur compounds in a diesel fuel. Methanol, dimethyl formamide, and N-methyl pyrrolidone were used as simple one-stage extraction solvents at different ratios. No mention of a process is made within this publication. Instead, the authors describe laboratory studies of the oxidation and extraction of sulfur compounds using methods like those taught in the art described above.

Two major problems are seen throughout this art. First, the oxidants chosen do not always perform optimally. Many oxidants engage in unwanted side reactions that reduce the quantity and quality of the treated fuels. The second problem is the selection of a suitable solvent for the extraction of the sulfur or nitrogen compounds. Using the non-optimum solvent may result in costly solvent recovery processing and removing desirable compounds from the fuel or extracting less than a desired amount of the sulfur and nitrogen compounds from the fuel. In either case, the results can be prohibitively expensive.

The reason for oxidizing the thiophenes in the feedstock to the corresponding sulfones or sulfoxides is to increase their polarity and molecular weight in order to facilitate their separation by extraction or distillation. The thermodynamics of the oxidation reaction is favorable, and it proceeds with reasonable selectivity at near-ambient temperature and pressure when the appropriate oxidant and operating conditions are selected. At least in theory, the final by-product can be elemental sulfur, sulfur dioxide or trioxide, sulfurous or sulfuric acid, or any of a variety of sulfur-containing salts. Most importantly, this approach avoids the need for using hydrogen and the attendant costs and safety issues. This technique is disclosed in the U.S. Pat. to Walter Gore, No. 6,160,193 entitled Method of Desulfurization of Hydrocarbons, which is incorporated herein by reference.

Reaction selectivity, safety and cost are the important concerns for the selection of oxidant, catalyst, and operating conditions for oxidative-extraction desulfurization processing. Different oxidants and operating conditions will result in different degrees of thiophene conversion, different product yields, operating costs and safety concerns. Considering air oxidation, for example, there are concerns that the reactivity and selectivity may not be adequate in the presence of hydrocarbons, and that the presence of nitrogen would require costly product recovery measures. However, using enriched air instead may seriously compromise process-operating safety. Several oxidants meet the required selectivity and safety criteria. Among them are three industrially viable oxidants, hydrogen peroxide, peroxyacetic acid and Caro's acid.

Oxidation and solvent extraction of the target thiophene compounds has been explored by a number of companies over the past 50 years, [reference e. g., extraction processes by UOP U.S. Pat. No. 5,582,714 and GSK U.S. Pat. No. 5,494,572, and oxidation processes by Exxon R&EC U.S. Pat. No. 5,910,440, Novetech U.S. Pat. No. 5,824,207, Petro Star Inc Bonde, S. E. et al., ACS Div. Pet.Chem Prepritns 44(2), 199(1998), Fukuoka-ken U.S. Pat. No. 5,753,102, Ford et al U.S. Pat. No. 3,341,448, and Noble et al U.S. Pat. No. 2,749,284].

The oxidation reaction with substituted benzothiophenes proceeds to the corresponding sulfones at reasonable rates based on a number of reagents explored in the chemical literature [reference e. g., Bonde, S. E., Gore, W., and Dolbear, G. E., Am. Chem. Soc., Div. Petrol. Chem,. PREPRINTS, 44(2), (1999); Attar, A., Corcoran, W. H., I&EC Prod. Res. Dev, 17(2) 102 (1978); Zannikos, F., Lois, E., Stournas, S., Fuel Processing Technology, 42, 33 (1995); Guth, E. D., U.S. Pat. No. 3,847,800 (1975); Guth, E. D., U.S. Pat. No. 3,919,402 (1975); Tam, P. S., Kittrell, J. R., and Eldridge, J. W., I&EC Research, 29, 321–324 (1990)].

Other patents of interest include U.S. Pat. Nos. 3,413,307, 4,493,765, 4,954,229, 5,228,978, and 5,458,752.

The solvent extraction of the thiophene-oxides produced in the oxidation reaction becomes the second process step in the process. The need for alternative desulfurization processes for liquid fuels will increase dramatically with the implementation of ultra-low sulfur specification rules worldwide. As liquid fuel specifications drop below 100 ppm sulfur to 30 ppm or lower, particularly the small and medium size petroleum refiner must find alternative, cost effective process solutions that will allow the operation to remain competitive. Of course, the feed and final product specification will influence the process design directly.

BRIEF SUMMARY OF THE INVENTION

Hydrocarbon fuels suitable for treatment with this process include atmospheric and vacuum gas-oils and products made from them. These include diesel fuel, home heating fuel, turbine fuels, kerosene, and various solvents and specialty fuels having similar distillation ranges. Hydrotreated middle distillates may also be treated with the process. The process may also be used for petroleum-derived liquid fuels boiling outside this temperature range; including gasoline range naphthas and various higher boiling gas oils and fuels.

The first objective of the process is to remove sulfur-aromatic compounds, i.e., substituted benzo- and dibenzo-thiophenes and their homologues that are costly and difficult to remove by hydroprocessing. A second objective is to allow simultaneous extraction of nitrogen-containing and aromatic hydrocarbons from the raffinate so that a desired combination of residual aromatics and low sulfur and nitrogen content can be obtained.

The process consists of a combination of several consecutive steps. These process steps are thiophene extraction; thiophene oxidation; thiophene-oxide and -dioxide extraction; raffinate recovery and polishing; solvent recovery; recycle solvent purification; and sulfur removal from the aromatic extract. The operating conditions are relatively mild throughout in the process. Pressures are near ambient and temperatures are less than 145° C. throughout the process. The only chemical consumed in the process is hydrogen peroxide.

In the thiophene extraction step, the objective is to remove 5–65% of the thiophenic material, a substantial part of any present nitrogen-containing compounds, and parts of the aromatics from the feed stream. The feed is contacted in countercurrent flow with a solvent to yield a raffinate phase and an extract phase. The operating conditions during this phase are a temperature of between about 20 and 90° C., pressures of between about 1 and 10 Bar. The solvent to feed ratio is between about 0.5:1 and 2:1.

The purpose of the thiophene oxidation step is to convert the remaining unextracted benzo- and dibenzo-thiophenes and their substituted homologues into the corresponding thiophene mono- and di-oxides in order to facilitate their subsequent extraction. Any nitrogen-containing compounds remaining in the treated liquid are converted to the corresponding N-oxide compounds. In this step, the raffinate from the thiophene extraction step above is mixed with an oxidant prepared in situ or previously formed. The feed is heated to the desired reaction temperature in a heat exchanger, and the reaction can be conducted either isothermally or adiabatically. Generally the oxidation operating conditions include a molar ratio of $H_2O_2$ to S between about 1:1 and 2.2:1, acetic acid content between about 5 and 45% of feed, solvent content between about 10 and 25% of feed, a temperature of between about 0 and 110 C., and a catalyst volume of less than about 5000 ppm sulfuric acid and preferably less than 1000 ppm. Once the reaction is complete, the effluent from the reactor flows directly to a thermal "peroxide-elimination" unit comprising a feed-effluent heat exchanger, a heater providing 1–5 minutes residence time at 130–145° C. (to eliminate all residual peroxides), and a product cooler. Due to the small residual amount of peroxides, the heat release is practically negligible.

The purpose of the thiophene-oxide and -dioxide extraction step of the process is to remove by extraction more than 90% of the various substituted benzo- and di-benzo-thiophene-oxides, including thiophene oxide and thiophene dioxides, also called thiophene sulfoxides and thiophene sulfones, and their various alkylated and arylated homologues. The process is also designed to remove any N-oxide compounds present in the oxidized liquids, as well as to remove a fraction of the aromatics from the feed stream. The effluent from the oxidation product cooler from the process above is contacted in countercurrent flow with the solvent to yield a raffinate phase and an extract phase. The extracting solvent is aqueous acetic acid with one or more co-solvents. The cosolvent may be selected from a family of acids including formic, acetic, propionic, butyric, isobutyric, valeric and various branched isomers, and caproic and its various branched isomers. The extraction column can be operated over a range of temperatures, solvent compositions and feed to solvent ratios to accommodate various feed compositions and raffinate product specifications for sulfur and aromatics. Typically, the operating conditions are temperatures between about 20 and 90° C., pressures between about 1 and 10 Bar, and solvent to feed ratios between about 0.5:1 and 2.5:1. Other values outside these ranges are also possible. The extraction device can be a packed or multi-tray column with or without induced pulsation or intermittent mixing; however, any suitable combination of single or multi-stage liquid-liquid contacting and separation equipment can be used.

Depending on the solubility of the selected solvent and operating conditions, a smaller or larger amount of solvent remains in the raffinate effluent from the extraction. This solvent can be removed in various ways, including a combination of distillation, countercurrent water wash, and adsorption. In one embodiment of the process, the raffinate is washed in a single or multi-stage mixer-separator with water at between about 20 and 40 C. and ratios of water to raffinate between about 0.05:1 and 0.5:1. The bottom effluent, containing solvent, water and a small amount of oxidation catalyst, goes to the solvent recovery step. If required by the raffinate product specifications, the raffinate water wash is followed by a drying step using either a flash distillation or solid adsorbent bed such as silica, zeolite or alumina. This process step also eliminates any residual solvent remaining in the raffinate stream. As desired, this can be followed by a second adsorbent bed with activated granulated carbon, alumina, zeolite, fuller's-earth or similar material to further reduce the residual sulfur compounds to meet or exceed the final product specification. Typically, a decrease of sulfur content between about 10 and 500 ppm S can be achieved in this process step. The election to remove more or less sulfur compounds in the extraction and adsorption sections is an economic decision that depends on the relative cost of the two operations.

Next, the extracts from the thiophene extraction and thiophene-oxide extraction can be processed singly or together depending on the specifications of the extract products. The solvent can be removed by a combination of distillations and water washes. After solvent recovery, depending on the character of the feedstock, the recovered extract typically consists of approximately 10–25 wt % sulfur-containing compounds and 10–30% aliphatic compounds, with the balance being aromatic compounds.

The solvent-containing streams from the water washes and co-solvent distillations are combined and fed to a solvent purification distillation column. The mixture of co-solvent and water is removed overhead and recycled to the water wash process steps, except for an amount corresponding to the water produced in the oxidation reaction, which is discharged. If desired for environmental reasons, the wastewater may pass through an activated carbon or similar absorber prior to discharge. The distillation column can be designed and operated so that the solvent recovered at the bottom meets recycle solvent specifications, i.e., it does not need to be pure solvent but may contain small amounts of hydrocarbons and co-solvents. In most cases where the feedstock composition results in a build-up of recycle hydrocarbons, a small side stream taken from the recycle solvent stream will resolve the problem.

The extract obtained from the thiophene and thiophene-oxide extraction can be further processed, separately or together, after solvent recovery. If desired the sulfur-containing compounds can be separated from the hydrocarbons for use as intermediate chemicals. Alternatively, the extract may be processed to remove the sulfur moiety to produce a low-sulfur fuel stream or aromatics feedstock. Several chemical and biochemical processes have the capability to accomplish these transformations.

The process design can be modified to accommodate a variety of hydrocarbon feeds; however, the boiling range of the feed will to a large extent determine the suitability of any specific solvent combination because of the need to recover the solvent for recycle. Several process design variations and economic optimizations are readily apparent to the process designer skilled in the art. For example, depending on the final product specifications and feedstock quality the first thiophene extraction process step may be designed to remove a smaller or larger amount of thiophenes and aromatic compounds, leaving the rest to be oxidized and extracted downstream. The design optimization is a trade-off between the cost of oxidation and the cost of the two extractions, including the cost of solvent recovery and recycle. The thiophene extraction therefore may be eliminated in some cases where the feedstock and product specifications so indicate.

It is an object of this invention to produce a method of extracting sulfur from hydrocarbons using acetic acid as a solvent.

It is another object of this invention to produce a process for extracting sulfur from hydrocarbons that has a first step of extracting substituted benzo- and di-benzo-thiophene compounds from the hydrocarbons.

It is another object of this invention to produce a process for extracting nitrogen-containing compounds from hydrocarbons.

It is yet another object of this invention to produce a process for extracting aromatic compounds from petroleum liquids and thereby to increase the cetane number in a diesel fuel.

It is yet another object of this invention to produce a process for extracting sulfur from hydrocarbons that has a thiophene oxidation step in the process.

It is yet another object of this invention to produce a process for extracting sulfur from hydrocarbons that has a thiophene-oxide and -dioxide extraction step in the process.

It is a further object of this invention to produce a process for extracting sulfur from hydrocarbons that has a raffinate recovery and polishing step.

It is yet another object of this invention to produce a process for extracting sulfur from hydrocarbons that has a solvent recovery step.

It is yet another object of this invention to produce a process for extracting sulfur from hydrocarbons that has a recycle solvent purification step.

It is a further object of this invention to produce a process for extracting sulfur from hydrocarbons that has a sulfur removal from the aromatic extract step.

DETAILED DESCRIPTION OF THE INVENTION

Figure 1:
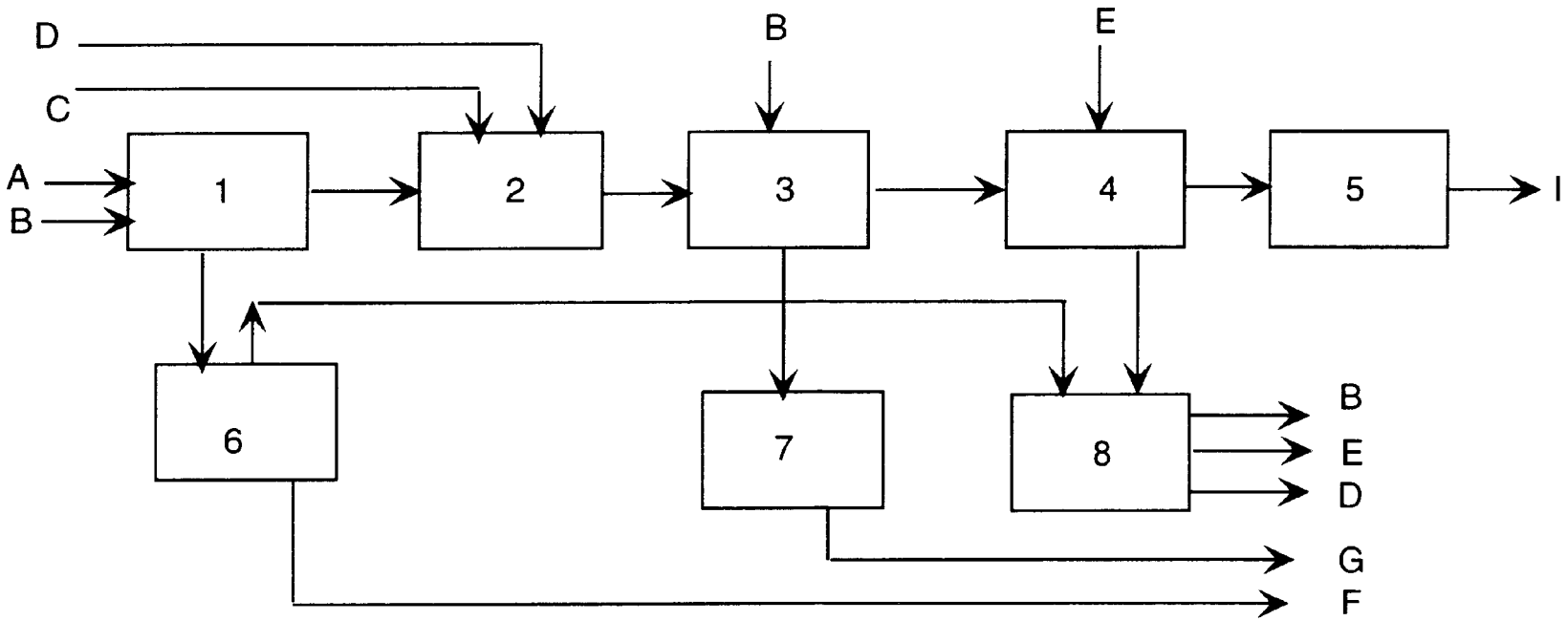
FIG. 1 is a schematic view of a multi-step process showing the separate steps of the process.

Referring now to FIG. 1, the process steps are defined as: Thiophene extraction 1; Oxidation 2; Sulfone extraction 3; Raffinate solvent recovery 4; Raffinate polishing 5; Extract-1 Solvent recovery 6; Extract-2 Solvent recovery 7; and Solvent purification 8. Each of these steps is discussed in detail below. Hydrocarbon fuels suitable for treatment with this process include gas-oils, light atmospheric gas-oils [LAGO], heavy atmospheric gas-oils [HAGO], vacuum gas-oils [VGO], heavy vacuum gas-oils [HVGO], kerosene, and hydrotreated middle distillates; however, the process is applicable also for fuels outside of this boiling range. The first objective of the process is to remove sulfur-aromatic compounds, i.e., substituted benzo- and dibenzo-thiophenes and their homologues that are costly and difficult to remove by hydroprocessing. A second objective is to allow the simultaneous extraction of aromatic hydrocarbons from the raffinate to obtain a desired combination of residual aromatics and sulfur content.

In addition to sulfur removal, this process also extracts nitrogen and its compounds as well.

Figure 2:
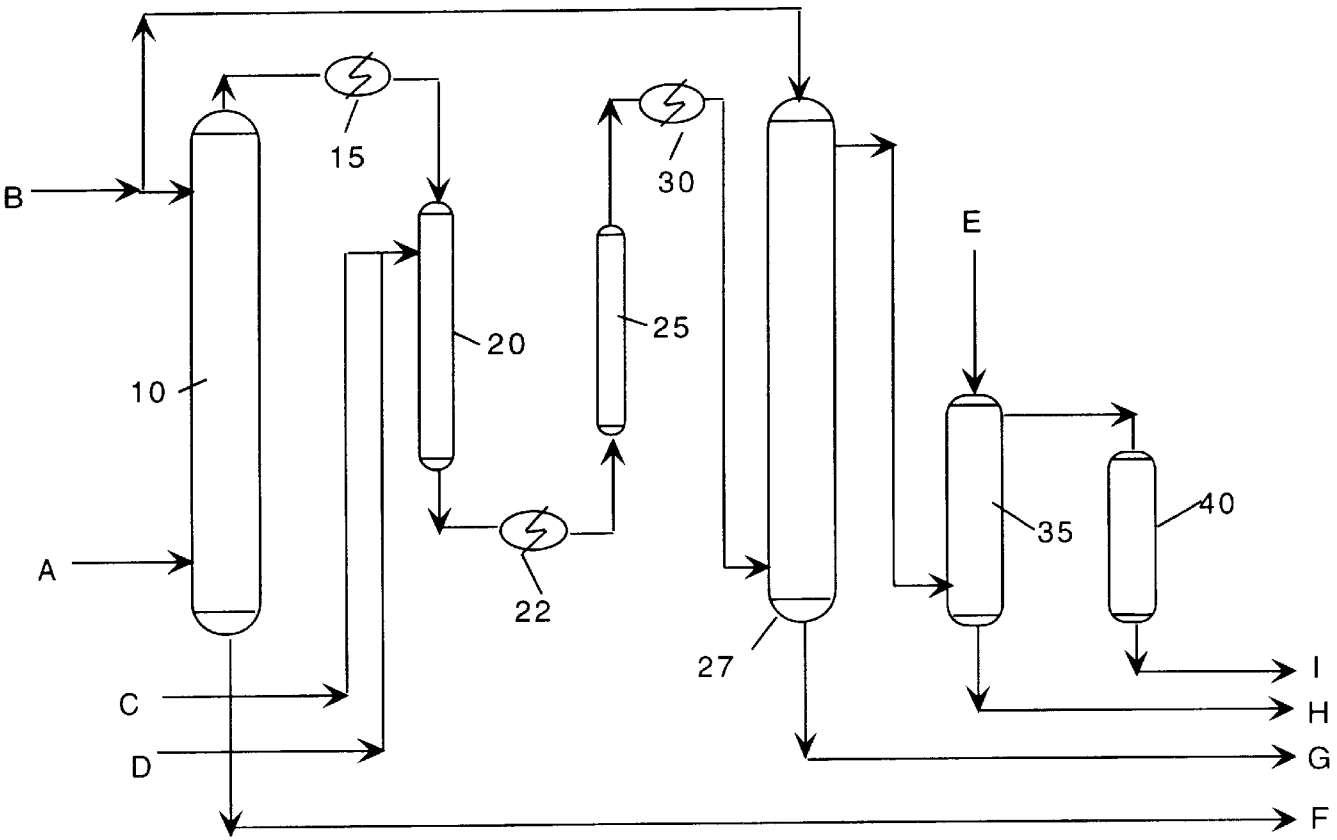
FIG. 2 is a diagrammatic process flow diagram showing the above process steps I through V.

Referring now to FIG. 2, the first five process steps are shown as performed in a production facility. The first step of the process is thiophene extraction 1. This step is designed to remove, by extraction, 5–65% of the thiophenic material plus parts of the aromatics from the feed stream as well as the nitrogen-containing compounds. As shown in FIG. 2, the petroleum liquid feed A is contacted in a reactor 10, in countercurrent flow with a solvent B to yield a raffinate phase I and an extract phase F. The extracting solvent is aqueous acetic acid, either alone or combined with two or more co-solvents, or an extract stream from the subsequent thiophenedioxide extraction supplemented with 0–100% additional solvent. The cosolvents available for this step are selected from those described below.

The operating conditions during this step are: temperature between about 20 and 90° C., pressure between about 1 and 10 Bar, and a solvent-to-feed ratio of between about 0.5:1 and 2:1. The extraction can be performed in a packed or trayed column with or without intermittent mixing or induced pulsation; however, any suitable single or multi-stage liquid-liquid contacting and separation equipment can be used.

The next step in the process is thiophene oxidation. This process step is designed to convert the benzo- and dibenzo-thiophenes, and their substituted homologues, into the corresponding thiophene mono- and di-oxides in order to facilitate their subsequent extraction. As shown in FIG. 2, the raffinate I from the thiophene extraction step 1 above is moved to an oxidation chamber 20, after passing through a feed heater 15. The raffinate I is then mixed with an oxidant C prepared in situ or previously formed. An example of a suitable oxidant is peracetic acid. Another example is a mixture of hydrogen peroxide in 20–70 wt % water solution and acetic acid or one of its homologues in molar excess over the hydrogen peroxide, as recycle solvent recovered from the downstream process. The process can be accelerated by the addition of a catalyst D, such as sulfuric acid. During this step, the oxidant-to-sulfur ratio can vary according to the nature and reactivity of the thiophene compounds, the product raffinate specification, the operating temperature, and the selected catalyst and the per-acid intermediate. Depending on the amount and type of oxidant used, the reaction mixture may be in one or two liquid phases.

The combined feed mixture is then heated to the desired reaction temperature in a heater or heat exchanger. The reaction can be conducted either isothermally or adiabatically. The reaction heat release is proportional to the amount of sulfur present, e.g., approximately 0.2–0.5% sulfur for a typical gas oil feed, and therefore relatively small—on the order of 4–10° C. For this step, the oxidation reactor 20 can be a packed or agitated column, one or more tanks in series, or a similar device that provides adequate phase mixing, minimum back-mixing, and the required residence time of 5–25 minutes to reach the desired conversion.

Generally the oxidation operating conditions have a ratio of $H_2O_2$ to S between about 1.5:1 and 2.2:1, an amount of acetic acid that is between about 5–25% of the feed, a solvent amount that is between about 10–25% of the feed, a temperature of between about 90° and 110° C., and a level of sulfuric acid catalyst less than about 1000 ppm. For example, a gas-oil feedstock having a sulfur content of approximately 0.5 wt % sulfur in the form of approximately 3.5 wt % mixed thiophenes, was mixed with 20 parts of acetic acid containing $H_2O_2$ and sulfuric acid to produce a mixture having a molar ratio of 1 sulfur to 2 and 500 ppm sulfuric acid as catalyst, based on the total volume of the reaction mixture. The reaction proceeded to completion at 95° C. in less than 30 minutes, converting the thiophenes quantitatively to sulfones.

Continuing with the overall process description, after the oxidation step, the effluent from the reactor flows through a feed cooler 22 and then directly into a thermal "peroxide-elimination" unit 25 consisting of a feed/effluent heat exchanger, a heater providing 1 to 5 minutes residence time at 130° to 145° C. to eliminate all residual peroxides. The mixture then passes through a product cooler 30. Due to the small residual amount of peroxides, the heat release is practically negligible in this step.

The next step is thiophene-oxide and -dioxide extraction. The objective here is to remove, by extraction, more than 90% of the thiophene-oxides, most of the remaining nitrogen-containing compounds, and parts of the aromatics from the feed stream. As shown in FIG. 2, the effluent from the oxidation product cooler 30 is placed into a sulfone extractor 27, where it is contacted in countercurrent flow with the solvent B to yield a raffinate phase I and an extract phase G. Typically, when using a mixture of acetic acid and water, the operating temperatures are between about 20° and 90° C., the pressures are between about 1 and 10 Bar, and the solvent-to-feed ratio is between about 0.5:1 and 2.5:1. Other values outside these ranges are also possible. The extraction column can be operated over a range of temperatures, solvent compositions, and feed-to-solvent ratios to accommodate various feed compositions and raffinate product specifications for sulfur and aromatics. The extraction device 27 can be a packed or multi-tray column with or without induced pulsation or intermittent mixing; however, any suitable combination of single or multi-stage liquid-liquid contacting and separation equipment can be used Depending on the solubility of the solvent and operating conditions, a smaller or larger amount of solvent remains in the raffinate effluent I from the extraction. This solvent can be removed in various ways, including a combination of distillation, countercurrent water wash, and adsorption. In one embodiment of the process, as shown in FIG. 2, the raffinate I is washed in a single or multi-stage mixer-separator 35 with water E at a temperature between about 20° and 40° C. and a water-to-raffinate ratio between about 0.05:1 and 0.5:1. The bottom effluent H, containing solvent, water and a small amount of oxidation catalyst, is transported to solvent recovery and purification steps as shown on FIG. 1.

If required by the raffinate product specifications, a raffinate water wash can be followed by a raffinate polishing step, where the raffinate is placed in a raffinate polishing absorber 40. This step is a drying step that uses either a flash distillation or solid adsorbent bed of material such as silica, zeolite or alumina. This process step also eliminates any residual solvent remaining in the raffinate stream. If desired, this can be followed by a second adsorbent bed with activated granulated carbon, alumina, zeolite, fuller's-earth or similar material to further reduce the residual sulfur compounds to meet or exceed the final product specification. At the end of this step, the fully treated petroleum liquid raffinate I is released. Typically, a decrease of sulfur content of between about 10 and 500 ppm S can be achieved in this process step.

The election to remove more or less sulfur compounds in the extraction and adsorption sections (step 5 of FIG. 1) is an economic decision that depends on the relative cost of the two operations. The absorbers can be on a single bed or on several separate beds or vessels. These process steps can be performed equally well as batch or continuous flow operations as dictated by the economic requirements. The absorbers can be regenerated by circulating a small amount of hot feed or product at temperatures of between about 100° and 160° C. through the beds and recycling the sulfur-rich effluent back to the solvent extraction section after cooling.

Next, as shown in FIG. 1, the extract from the thiophene extraction and thiophene-oxide extraction can be processed singly or together depending on the specifications of the extract products. The extract phases from both extractions contain approximately 80 to 90% solvent and 10 to 20% hydrocarbons and sulfur-containing compounds. The solvent can be removed by a combination of distillations and water washes. For example, the extract may subjected to a simple flash distillation where 3 to 10% of the solvent and lower boiling co-solvent is taken as overhead product, condensed and fed to a solvent purification column. The extract-phase then goes to a second flash distillation where 50 to 80% of the solvent is recovered, under conditions that ensure that this solvent meets solvent recycle specifications. At this point, the extract-phase now contains 5–25% solvent, which can be recovered by distillation in a short column or by water-wash. The process design choice is determined by economics and also depends on the specifications of the original feedstock, solvent selection, boiling points and phase density differences, as will be apparent to workers skilled in the art.

After solvent recovery, depending on the character of the feedstock, the recovered extract will consist of approximately 10 to 25 wt % sulfur-containing compounds and 10 to 30% aliphatic compounds, with the balance being aromatic compounds.

FIG. 1 shows two separate solvent recovery steps. As part of the thiophene extraction step (step 1), the thiophene-containing solvent is moved to a treatment step 6 in which most of the thiophenes are removed as product F. The cleaned solvent is then moved to step 8 for final purification. The solvent used as part of the sulfone extraction step (step 3) is treated at step 7. In this step, the sulfones G are extracted and the treated solvent is moved to step 8 for purification. These two solvent-containing streams from the water washes and co-solvent flashes are combined and fed to a solvent purification distillation column at step 8. Co-solvent water is removed overhead and recycled to the water wash process steps, except for an amount corresponding to the water produced in the oxidation reaction, which is discharged. If desired for environmental reasons, the wastewater may pass through an activated carbon absorber prior to discharge. The distillation column can be designed and operated so that the solvent recovered at the bottom meets recycle solvent specifications. It therefore does not need to be pure solvent but may contain small amounts of hydrocarbons and co-solvents. For cases where the feedstock quality results in a build-up of recycle hydrocarbons, a small side stream taken from the recycle solvent stream resolves the problem in most cases. In a process variation, the extract water wash phase, which contains water, solvent, oxidation catalyst and a small amount of hydrocarbons, is flash distilled to recover most [approximately 80 to 90%] of the water and solvent overhead. The overhead feeds to the solvent purification column, and the bottoms are recycled to the oxidation process step with catalyst containing the balance of hydrocarbons and solvent. Thus, the end result of step 8 is a set of treated streams for solvent B, process water E, and recycled catalyst D.

The extracts F and G obtained from the thiophene and thiophene-oxides extraction can be further processed, separately or together, after solvent recovery. If desired, the sulfur-containing compounds can be separated from the hydrocarbons for use as intermediate chemicals; or the extract can be processed to remove the sulfur-containing species to produce a low-sulfur fuel stream or aromatics feedstock. For example, as taught by Huff et al U.S. Pat. No. 6,048,451, the extract can be treated with an alkylating agent [alcohol or olefin] at temperatures in excess of 100° C. in the presence of an acidic catalyst to convert the organic sulfur compounds to higher boiling sulfur-containing materials. These can be fractionated by distillation to yield a low sulfur distillate and a high boiling sulfur-rich fraction. In addition, several chemical and biochemical processes have the capability to accomplish similar transformations, which are outside the scope of this invention.

The extraction solvent used in the process, aqueous acetic acid, may be mixed with cosolvents of one or more compounds selected from the following groups: lower carboxylic acids including formic-, acetic-, propionic-, n- and iso-butyric-, pentanoic acid and their homologues; lower alcohols including methanol, ethanol, n- and iso-propanol, n- and iso-butanol and their homologues; valeric and various branched isomers, and caproic and its various branched isomers and water. Thus, the solvent can be a single compound of acetic acid and water, a mixture of two or more compounds in semi-equal proportion, or a principal compound admixed with one or several co-solvent compounds in minor quantities. Solvent synergism has been discovered that leads to improved extraction selectivity by using co-solvent systems for the thiophene and thiophene-oxides extractions. For example, acetic acid with between about 0.5–5.0 wt % water, and preferably between about 1.5–3.5% water, is more selective and results in higher yields of the desired extract than pure acetic acid. Several other solvent combinations show similar advantages.

In addition to the solvent, the extraction temperature is a determining operating parameter for process optimization. For example, the partition coefficient for thiophene-dioxides between the hydrocarbon and solvent phases at 20° C. is double the value at 70° C. with a 2%:98% water-to-acetic acid solvent mixture. The optimum extraction temperature depends upon the solvent composition, the thiophene and thiophene-oxides molecular composition and molecular weight distribution, and the feed hydrocarbon composition, notably the aromatics content and composition. It is therefore necessary to optimize the extraction processes for each individual feedstock based on experimental extraction data.

The extraction of aromatic compounds simultaneous with the sulfur containing compounds also can be controlled, within limits, by manipulating the solvent composition and operating temperature. In addition, the solvent-to-feed ratio and number of extraction stages can be designed to yield more or less selectivity of aromatics and sulfur removal, and thereby determine the respective yields and composition of the raffinate and extract products. This manipulation of the design and operating parameters can be useful in the optimization of the product slate and economics of the process. For example, it is well known in the art that an increase of the solvent/feed ratio results in an increase of the amount of aromatics extracted while the ratio of aromatics to sulfur-aromatics in the extract also increase.

Other properties of solvent mixtures are ease of recovery and recycle, chemical stability, low cost, and low toxicity. Solvent mixtures should also be essentially inert to reactions with the feedstock hydrocarbons. It is also an advantage for the solvent to be compatible with the oxidation reaction, allowing it to pass through from the thiophene extraction without harming the reaction. In addition, it is a substantial advantage if one or more of the solvent components can participate as an intermediary reactant in the oxidation reaction. An example of such a compound is acetic acid and its homologues, which form peroxy-acid intermediary oxidants with hydrogen peroxide. High extraction selectivity, safety considerations, process compatibility and low cost tend to dominate the selection for industrial application.

The process design can be modified to accommodate a variety of hydrocarbon feeds. However, the boiling range of the feed largely determines the suitability of any specific solvent combination because of the need to recover the solvent for recycle. Several process design variations and economic optimizations are readily apparent to the process designer skilled in the art. For example, depending on the final product specifications and feedstock quality, the first thiophene extraction process step may be designed to remove a smaller or larger amount of thiophenes and aromatic compounds, leaving the rest to be oxidized and extracted downstream. The design optimization is a trade-off between the cost of oxidation and the costs of two extractions including the solvent recovery and recycle steps. The thiophene extraction therefore may be eliminated in some cases where the feedstock and product specifications so indicate.

Another example of optimization is the possibility of processing the two extracts together for solvent recovery. Doing this reduces complexity by eliminating several pieces of equipment. Another example of the possibility of design optimization, readily apparent to those skilled in the art, is in the solvent recovery section. Here the optimum design depends heavily on design capacity of the plant, the quality of the feedstock and the final product specifications. Yet another area of optimization is the oxidation reaction where the intermediate oxidant, peracetic acid or a homologue, can be formed in situ in the hydrocarbon feed stream, in a separate preliminary process step on-line, or in a tank.

Another optimized process design results from using the extract from the thiophene-oxide extraction as the solvent, or a major part of the solvent, for the thiophene extraction. In this example, volumes and compositions were estimated using a chemical engineering process model computer program that had previously been checked against a variety of laboratory experimental measurements. Such models are widely used in chemical engineering work for their ability to predict results under steady-state operating conditions. Here the model was set-up to extract an oxidized feed stream at a temperature of 20 C. with recycle acetic acid solvent from the solvent recovery section at a ratio of 1:1 solvent-to-feed using 3 countercurrent stages. For feed in this example, we use a light atmospheric gas oil distilled from Alaska North Slope crude oil; for extraction solvent we use a mixture of 2.5% water and 97.5% acetic acid. At steady state, the extract volume is approximately equal in volume to the solvent used in the extraction. Detailed calculations show that it contains approximately 86% acetic acid, 3.5% water [including reaction water from the oxidation that had not been separated], 2% sulfones and 8.5% hydrocarbons. The raffinate contains approximately 15% solvent. The extract is fed to the middle of a 3-stage thiophene extraction column operated at 45 C. Fresh recycle solvent is added to the top stage at 1:1 ratio of solvent to feed. Calculations show that the resulting raffinate from the thiophene extraction contains 20% solvent and is depleted from 4600 ppm sulfur to 3400 ppm, and from 34% aromatics to approximately 22%. It is found that the mostly-aromatic hydrocarbons entering the second extraction as part of the solvent improve the thiophene extraction in selectivity. The combined extracts issuing from the bottom of the thiophene column contain 99+% of the sulfur and 65% of the aromatic compounds entering with the feed. The computerized chemical engineering model shows that at steady-state operation the recycle of hydrocarbons and sulfur compounds from the thiophene extraction back to the sulfone extraction are insignificant.

Further examples of the extraction of sulfur species from hydrocarbon fuels using acetic acid-water mixtures follow:

EXAMPLE 1

In a laboratory experiment, a sample of light atmospheric gas oil, LAGO, was obtained by distillation of Alaska North Slope crude at Petro Star Refining's refinery in Valdez, Ak. The sample contained 0.42 wt % sulfur, as measured by a conventional x-ray Fluorescence (XRF) technique. Other properties as measured by standard ASTM methods are summarized in Table 2.

TABLE 2

| LAGO Properties | |
|---|---|
| API Gravity | 33.3 |
| Distillation Range | |
| IBP | 366° F. |
| 10% | 440° F. |
| 50% | 562° F. |
| 90% | 620° F. |
| EP | 660° F. |
| Sulfur | 0.42 wt % |

Thiophene Extractions

EXAMPLE 2

In this laboratory example, acetic acid containing 2 wt % water was used to extract sulfur-containing species from LAGO. The extraction solvent was prepared by adding a measured volume of deionized water to reagent quality acetic acid. In the experiment, equal masses of LAGO and extraction solvent were mixed in a stirred flask fitted with a reflux column. The mixture was brought to 60° C., mixed one hour to reach equilibrium, and then allowed to stand without mixing a few minutes, when a lighter oil phase (raffinate) separated from the heavier acetic acid phase (extract). A pipette was used to withdraw samples from each phase for analysis.

The liquid samples were analyzed by the combination of gas chromatography (GC), mass spectroscopy (MS), and atomic emission detection (AED). AED parameters were set to measure the level of sulfur in the various compounds found in the samples. GC/MS allowed measurements of acetic acid and hydrocarbons in the samples. The resulting data were used to calculate compositions for the extract and the raffinate. Sulfur levels in the raffinate, as measured by GC/AED, were 27% lower than in the unextracted LAGO.

EXAMPLE 3

In a second laboratory experiment with LAGO and aqueous acetic acid, carried out in the same manner as the experiment in Example 2, the extraction solvent contained 10 parts water to 90 parts acetic acid. The temperature was again brought to 60° C., and mixing time was one hour. When stirring was stopped and the raffinate separated from the extract, samples were taken and analyzed. Sulfur levels in the raffinate were 4% lower than in the untreated LAGO.

EXAMPLE 4

In a third laboratory experiment, the extraction solvent contained 5 parts water to 95 parts acetic acid. This time the extraction temperature was 20° C., and the mixing time was again one hour. Analyses revealed that sulfur levels in the raffinate were 14% lower than in the untreated LAGO.

The results of the experiments described in Examples 2, 3, and 4 show that mixtures of acetic acid and water are effective in extracting sulfur-containing molecules from LAGO and similar distillate hydrocarbon fuels. The results also show that the effectiveness of the extraction is very sensitive to the amount of water in the mixture and the temperature of the operation. They also show a preferred process at a relatively low level of water, i.e., 2 wt %. As will be obvious to those skilled in the art, this sensitivity, probably resulting from the complexity of the acetic acid-water system, gives the user great control over the operation.

EXAMPLE 5

A sample of LAGO, described in Example 1, above, was subjected to selective oxidation using aqueous peroxyacetic acid. The oxidant was made by dropwise addition of commercial 50% hydrogen peroxide to a well-stirred solution of 20 mL aqueous acetic acid containing 1.0 g sulfuric acid. The sulfuric acid is known to be a catalyst for the formation of peroxyacetic acid in this system.

To a well-stirred sample of 400 mL of LAGO, 85 mL of the peroxyacetic acid was added dropwise. The temperature was raised to 90° C. and held for 20 minutes. Then the product was cooled to room temperature and transferred into a separatory funnel. To the separatory funnel 20 mL of tap water was added and shaken to contact the layers for 1 minute. This step was performed twice. The aqueous phase contained the acetic acid, the sulfuric acid, and any unused hydrogen peroxide or peroxyacetic acid. The oil layer was separated and dried over anhydrous, granular sodium sulfate.

Analysis using GC/AED confirmed that all of the thiophenic organo-sulfur species had been oxidized to the corresponding sulfones, according to the general reactions shown below.

EXAMPLE 6

In this example, acetic acid containing 2 wt % water was used to extract sulfur-containing species from LAGO. The extraction solvent was prepared by adding a measured volume of deionized water to reagent grade acetic acid. The oxidized LAGO was prepared as described in Example 5. Equal masses of oxidized LAGO and extraction solvent were mixed in a stirred flask fitted with a reflux column. The mixture was brought to 60° C., mixed one hour to reach equilibrium, and then allowed to stand without mixing a few minutes, when a lighter oil phase (raffinate) separated from the heavier acetic acid phase (extract). A pipette was used to withdraw samples from each phase for analysis. The liquid samples were analyzed as described in Example 2. Sulfur levels in the raffinate, as measured by GC/AED, were 75% lower than in the unextracted oxidized LAGO.

EXAMPLE 7

The laboratory experiment described in Example 6 was repeated using 100% acetic acid as the extraction solvent. The temperature was 80° C., and mixing time was one hour. When stirring was stopped and the raffinate separated from the extract, samples were taken and analyzed. Sulfur levels in the raffinate were 55% lower than in the unextracted oxidized LAGO.

EXAMPLE 8

In a third laboratory experiment, the extraction solvent again contained 2 parts water to 98 parts acetic acid. This time, the extraction temperature was 15° C. After mixing and separation, analyses revealed that sulfur levels in the raffinate were 82% lower than in the unextracted oxidized LAGO.

The results of the experiments described in Examples 6, 7, and 8 show that mixtures of acetic acid and water are very effective for extraction of aromatic sulfones from a sample of LAGO that has been selectively oxidized with peroxyacetic acid. The results also show again that the effectiveness of the extraction is very sensitive to the amount of water in the mixture and the temperature of the operation. Like the extractions of sulfur species described in Examples 2–4, they show an optimum at a relatively low level of water, e.g., 2 wt %. In contrast to the extractions described in examples 2–4, the experiments in Examples 6–8 reveal an optimum temperature at or just below room temperature.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A method for desulfurizing petroleum liquid, comprising the steps of:

a) extracting at least a portion of thiophene compounds from said petroleum liquid by solvent extraction to provide a petroleum liquid having residual thiophene compounds;

b) oxidizing residual thiophene compounds in said petroleum liquid to provide a petroleum liquid having thiophene-oxide and thiophene-dioxide compounds; and c) extracting the thiophene-oxide and thiophene-dioxide compounds from said petroleum liquid, to provide a desulfurized petroleum liquid.

2. The method of claim 1 further comprising the steps of:

a) recovering the desulfurized petroleum liquid; and b) purifying said recovered petroleum liquid.

3. The method of claim 1, wherein the petroleum liquid is selected from the group consisting of: diesel fuel, light atmospheric gas oil, crude oil, heavy atmospheric gas oil, vacuum gas oil, FCC light cycle oil, coker gas oil, and naphtha.

4. The method of claim 1, wherein the thiophene compounds comprise at least one of: thiophene, benzothiophene, dibenzothiophene, naphthobenzothiophene and dinaphthothiophenes.

5. The method of claim 1, wherein the thiophene-oxide and thiophene-dioxide compounds comprise at least one of: thiophene-oxide (sulfoxide), thiophene-dioxide (sulfone), benzothiophene-oxide (sulfoxide), benzothiophene-dioxide (sulfone), dibenzothiophene-oxide (sulfoxide), dibenzothiophenes-dioxide (sulfone), naphthobenzothiophene-oxide (sulfoxide), naphthobenzothiophene-dioxide (sulfone), dinaphthothiophene-oxide (sulfoxide) and dinaphthothiophene-dioxide (sulfone).

6. The method of claim 1, wherein the step of oxidizing the residual thiophene compounds is performed using hydrogen peroxide as an oxidant.

7. The method of claim 6, wherein the oxidation is performed in the presence of a catalyst.

8. The method of claim 7, wherein the catalyst comprises an organic acid.

9. The method of claim 1, wherein the step of oxidizing the residual thiophene compounds is performed using peracetic acid.

10. The method of claim 1, wherein the step of oxidizing the residual thiophene compounds is performed using hydrogen peroxide at a temperature of between about 15° C. and about 105° C.

11. The method of claim 10, wherein the step of oxidizing the residual thiophene compounds is performed with a catalyst.

12. The method of claim 11, wherein the catalyst is an acid.

13. The method of claim 12, wherein the acid is sulfuric add.

14. The method of claim 1, wherein the step of extracting the thiophene-oxide and thiophene-dioxide compounds is performed using an extraction solvent.

15. The method of claim 1, wherein the sulfur compounds in the petroleum liquid is reduced by 50%.

16. The method of claim 1, wherein the desulfurized petroleum liquid has a cetane value of between about 40 and 70.

17. The method of claim 1, wherein the desulfurized petroleum liquid has an API gravity of between about 25 and 45.

18. The method of claim 2, wherein the recovered petroleum liquid is purified using adsorbents.

19. The method of claim 1, wherein the step of oxidizing residual thiophene compounds comprises oxidizing with Caro's acid.

20. The method of claim 18, wherein the adsorbents are solid adsorbents.

21. A method for desulfurizing a feedstock of petroleum liquid containing a sulfur compound, comprising the steps of:

a) extracting thiophene compounds from said petroleum liquid by solvent extraction with a first solvent, to provide a petroleum liquid having residual thiophene compounds;

b) oxidizing residual thiophene compounds in said petroleum liquid with an oxident, to provide a petroleum liquid having thiophene-oxide and thiophene-dioxide compounds;

c) extracting thiophene-oxide and thiophene-dioxide from said petroleum liquid by extraction with a second solvent, to provide a raffinate, wherein the solvent is aqueous acetic acid;

d) recovering the second solvent;

e) recovering the raffinate; and f) purifying the raffinate to provide a liquid fuel product.

22. The method of claim 21, wherein the first and second solvents are acetic acid containing between 0.1 and 15 wt % water.

23. The method of claim 22, wherein the first and second solvents are acetic acid containing between about to 1 and 5 wt % water.

24. The method of claim 21, wherein the first and second solvents are the same solvent.

25. The method of claim 21, wherein the step of recovering the second solvent includes washing the solvent with a quantity of water.

26. The method of claim 25, further comprising the steps of:

a) recovering the quantity of water; and b) distilling the solvent.

27. The method of claim 26, wherein distilling the solvent comprises flash distillation.

28. The method of claim 26, wherein distilling the solvent comprises multistage distillation.

29. The method of claim 21, wherein the sulfur compounds in the petroleum liquid are reduced by 50%.

30. The method of claim 21, wherein the product liquid fuel has a cetane value of between about 40 and 70 and an API gravity of between about 25 and 45.

31. The method of claim 21, wherein the step of oxidizing residual thiophene compounds in said petroleum liquids comprises oxidizing with Caro's acid.

32. A method for desulfurizing a feedstock of a petroleum liquid containing a quantity of sulfur compounds, comprising the steps of:

a) extracting thiophene compounds from said petroleum liquid by extraction with a first solvent to provide a petroleum liquid having residual thiophene compounds;

b) oxidizing residual thiophene compounds, in said petroleum liquid; and c) extracting thiophene-oxide and thiophene-dioxide from said petroleum liquid, by extraction with a second solvent to provide a raffinate, wherein the second solvent is selected from the group consisting of acetic acid, propionic acid, butyric acid, isobutyric acid, valeric acid, and mixtures thereof;

d) repeating steps a–c until all of said feedstock has been treated to provide a liquid fuel product.

33. The method of claim 32 further comprising the steps of:

a) recovering the second solvent;

b) recovering the raffinate; and c) purifying the raffinate.

34. The method of claim 33, wherein the step of purifying the raffinate is performed using a solid adsorbent.

35. The method of claim 32, wherein the petroleum liquid is selected from the group consisting of: diesel fuel, jet fuel, light atmospheric gas oil, heavy atmospheric gas oil, vacuum gas oil, FCC light cycle oil, coker gas oil, and naphtha.

36. The method of claim 32, wherein the petroleum liquid has been hydrotreated to remove a fraction of sulfur compounds before the petroleum liquid is subjected to the extraction step.

37. The method of claim 32, wherein the thiophene compound comprises at least one of thiophene, benzothiophene, dibenzothiophene, naphthobenzothiophene, and dinaphthothiophenes.

38. The method of claim 32 wherein the thiophene-oxide and thiophene-dioxide compounds comprise at least one of: thiophene-oxide (sulfoxide), thiophene-dioxide (sulfone), benzothiophene-oxide (sulfoxide), benzothiophene-dioxide (sulfone), dibenzothiophene-oxide (sulfoxide), dibenzothiophenes-dioxide (sulfone), naphthobenzothiophene-oxide (sulfoxide), naphthobenzothiophene-dioxide (sulfone), dinaphthothiophene-oxide (sulfoxide), and dinaphthothiophene-dioxide (sulfone).

39. The method of claim 32, wherein the step of oxidizing the residual thiophene compounds comprises oxidizing with hydrogen peroxide.

40. The method of claim 39, further comprising oxidizing with a catalyst.

41. The method of claim 40, wherein the catalyst comprises an organic acid.

42. The method of claim 32, wherein oxidizing comprises oxidizing with peracetic acid.

43. The method of claim 32, wherein oxidizing comprises oxidizing with Caro's acid.

44. The method of claim 33, wherein the step of oxidizing the residual thiophene compounds is performed using hydrogen peroxide.

45. The method of claim 43, wherein the oxidation is performed at a temperature of between about 15° C. and about 105° C.

46. The method of claim 44, wherein the step of oxidizing comprises oxidizing with a catalyst.

47. The method of claim 46, wherein the catalyst is an acid.

48. The method of claim 47, wherein the acid is sulfuric acid.

49. The method of claim 33, wherein the step of recovering the second solvent includes washing the solvent with a quantity of water.

50. The method of claim 49, further comprising the steps of:

a) recovering the quantity of water; and b) distilling the solvent.

51. The method of claim 50, wherein distilling the solvent comprises flash distillation.

52. The method of claim 50, wherein distilling the solvent comprises multistage distillation.

53. The method of claim 32, wherein the sulfur compounds in the petroleum liquid are reduced by 50% by weight.

54. The method of claim 32, wherein the product liquid fuel has a cetane value of between about 40 and 70.

55. The method of claim 32, wherein the product liquid fuel has an API gravity of between about 25 and 45.

56. The method of claim 32, wherein the liquid fuel product is partially purified using adsorbents.

57. A method of desulfurizing of a feedstock of a petroleum liquid containing a quantity of sulfur compounds, comprising the steps of:

a) extracting thiophene compounds from said petroleum liquid by extraction with a fist solvent, to provide a petroleum liquid having residual thiophene compounds;

b) oxidizing residual thiophene compounds, in said petroleum liquid;

c) extracting thiophene-oxide and thiophene-dioxide, from said petroleum liquid, by extraction with a second solvent to provide a raffinate, wherein the second solvent is selected from the group consisting of: acetic acid, propionic acid, butyric acid, isobutyric acid, valeric acid;

d) recovering the second solvent;

e) recovering the raffinate;

f) purifying the raffinate;

g) adsorbing the extracted thiophene-oxide and thiophene-dioxide compounds on solid bed of adsorbent; and h) repeating steps a–g until all of the feedstock has been treated, to provide a liquid fuel product.

58. The method of claim 57, further comprising the step of regenerating the solid adsorbents after the thiophene-oxide and thiophene-dioxide compounds have been removed.

59. The method of claim 57, wherein the solids adsorbents are selected from the group consisting of silica gels, alumina gels, various clays including bentonite, kaolinite, montmorillonite, clinoptilolite, and their forms activated by various acid washing, drying, and calcining processes.

60. The method of claim 57, wherein the petroleum liquid is selected from the group consisting of: diesel fuel, light atmospheric gas oil, crude oil, heavy atmospheric gas oil, vacuum gas oil, FCC light cycle oil, coker gas oil, naphtha.

61. The method of claim 57, wherein the thiophene compounds comprise at least one of thiophene, benzothiophene, dibenzothiophene, naphthobenzothiophene, dinaphthothiophenes, and related higher aromatic thiophenes, and the alkyl and aromatic homologues of these compounds.

62. The method of claim 57, wherein the thiophene-oxide and thiophene-dioxide compounds comprise at least one of thiophene-oxide (sulfoxide), thiophene-dioxide (sulfone), benzothiophene-oxide (sulfoxide), benzothiophene-dioxide (sulfone), dibenzothiophene-oxide (sulfoxide), dibenzothiophenes-dioxide (sulfone), naphthobenzothiophene-oxide (sulfoxide), naphthobenzothiophene-dioxide (sulfone), dinaphthothiophene-oxide (sulfoxide), and dinaphthothiophene-dioxide (sulfone).

63. The method of claim 57, wherein the step of oxidizing comprises oxidizing with hydrogen peroxide.

64. The method of claim 63, wherein oxidizing comprises oxidizing with a catalyst.

65. The method of claim 64, wherein the catalyst comprises an organic acid.

66. The method of claim 57, wherein the step of oxidizing the residual thiophene compounds comprises oxidizing with peracetic acid.

67. The method of claim 57, wherein the step of oxidizing the residual thiophene compounds comprises oxidizing with Caro's acid.

68. The method of claim 57, wherein oxidizing comprises oxidizing with hydrogen peroxide.

69. The method of claim 68 wherein the oxidation is performed at a temperature of between about 15° C. and about 105° C.

70. The method of claim 68, wherein oxidizing comprises oxidizing with a catalyst.

71. The method of claim 69 wherein the catalyst is an acid.

72. The method of claim 71 wherein the acid is sulfuric acid.

73. The method of claim 57, wherein the sulfur compounds in the petroleum liquid are reduced by 50% sulfur.

74. The method of claim 57, wherein the liquid fuel product has a cetane value of between about 40 and 70.

75. The method of claim 57, wherein the liquid fuel product has an API gravity of between about 25 and 45.

* * * * *